US005518330A

United States Patent [19]

Gervais et al.

[11] Patent Number: 5,518,330

[45] Date of Patent: May 21, 1996

[54] FOUR PART BALL POINT PEN MECHANISM

[75] Inventors: Guy A. Gervais, Harrisville; Mitchell E. Seamans, Cumberland, both of R.I.

[73] Assignee: A.T. Cross Company, Lincoln, R.I.

[21] Appl. No.: 280,872

[22] Filed: Jul. 26, 1994

[51] Int. Cl.[6] ..... B43K 24/06

[52] U.S. Cl. ..... 401/116; 401/99

[58] Field of Search ..... 401/116, 109, 401/99

[56] References Cited

U.S. PATENT DOCUMENTS

| | | | |
|---|---|---|---|
| 2,516,938 | 8/1950 | Aimes | 401/116 X |
| 2,753,844 | 7/1956 | Boss | 401/116 |
| 3,272,184 | 9/1966 | Crowley | 401/116 |
| 3,436,160 | 4/1969 | Lanoie | 401/116 |
| 3,630,629 | 12/1971 | DiSpirito | 401/116 |
| 5,048,991 | 9/1991 | Guo | 401/116 |

*Primary Examiner*—Steven A. Bratlie

*Attorney, Agent, or Firm*—Colucci & Umans

[57] ABSTRACT

A four part writing instrument mechanism includes a one piece synthetic anchor bushing and a one piece synthetic cartridge shuttle which are axially movable with respect to each other. A metal driver with a helical section engages a groove in the shuttle for moving the shuttle axially. The driver is axially fixed but rotatable on the anchor bushing. A writing cartridge, such as a ball point pen cartridge, is fixed to the shuttle and has a writing point which is extendable from and retractable into an opposite end of the anchor bushing.

18 Claims, 5 Drawing Sheets

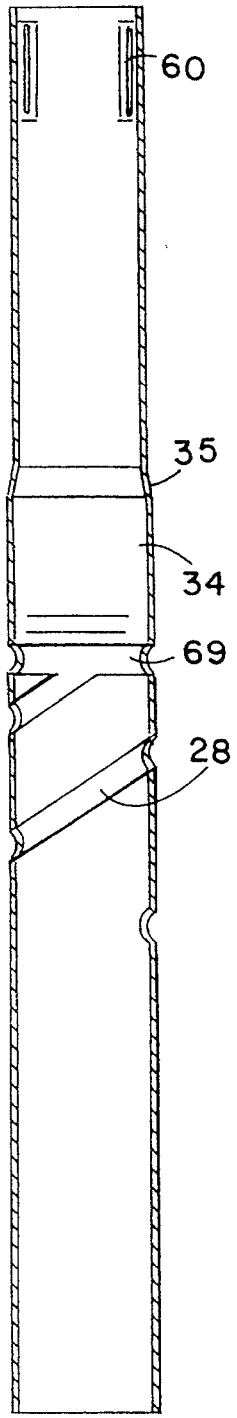
FIG. 4
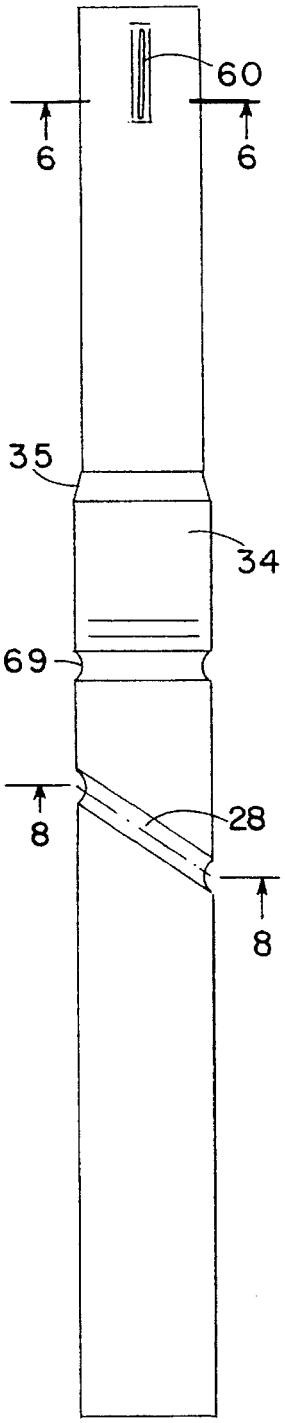
FIG. 5
FIG. 6
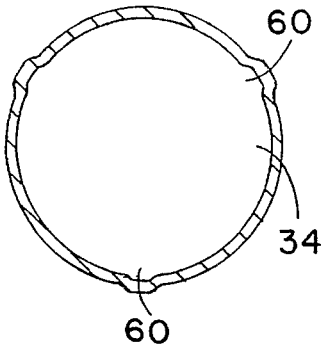
FIG. 7
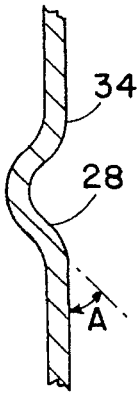
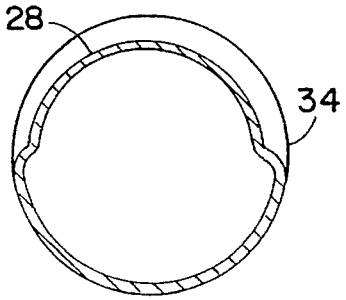
FIG. 8

FOUR PART BALL POINT PEN MECHANISM

FIELD AND BACKGROUND OF THE INVENTION

The present invention relates, in general, to writing instrument mechanisms, and in particular, to a new and useful four part mechanism for extending and retracting a writing point, for example, that of a ball point pen.

Currently, A. T. Cross Company, the assignee of the present application, is manufacturing and selling its very successful ball point pen using an internal 11 to 12 part mechanism. It would be advantageous to reduce the number of parts used to construct a mechanism having the same function while adapting the parts so that they can be assembled in an automated fashion.

A simplified ball point pen mechanism using a reduced number of parts is known from U.S. Pat. No. 2,753,844 invented by Ellery Boss and owned by A. T. Cross Company. The Boss patent, issued on an application filed in 1954, utilized metal parts predominantly and did not have access to modern synthetic materials. The parts of the mechanism were also constructed and shaped for assembly by hand since widespread mechanization did not exist at that time.

SUMMARY OF THE INVENTION

An object of the present invention is to provide a simplified mechanism for extending and retracting a writing point which uses a minimum of parts and is adapted for assembly on an automated basis. The materials for each of the parts were also selected for specific characteristics of the materials, keeping in mind which parts are movable with respect to other parts. The selection and combination of materials substantially eliminates the need for lubrication and reduces wear. A viscous damping fluid is needed, however, for smooth feel and quiet operation. This produces a mechanism having an exceedingly long useful life.

Another object of the present invention is to provide a method for assembling the parts of the mechanism in an automatic sequence which takes full advantage of the design and materials of the different parts.

In its preferred form, the invention comprises a four part and damping fluid, ball point pen or writing instrument mechanism, including a one-piece synthetic anchor bushing forming a fixed frame of reference and carrying part of an antirotation coupling, a synthetic one-piece cartridge shuttle carrying the other part of the coupling and mounted for axial, non-rotatable movement to the anchor bushing. The shuttle has a large diameter central portion carrying an external helical groove having spaced apart opposite ends. A one-piece metal driver is rotatably mounted to the anchor bushing and positioned for rotation around the shuttle. The driver has an internal helical section engaged with the helical groove of the shuttle so that rotation of the driver produces non-rotating axial movement of the shuttle. The one-piece shuttle also includes engagement means, e.g. an internal thread at its outer end for receiving and fixing a ball point pen or other writing instrument cartridge, which extends through the hollow bushing and through an end of a pen barrel which surrounds and is fixed to the anchor bushing. A mechanical compression spring is engaged between the synthetic bushing or a washer resting on the bushing. An annular ridge is made by reforming the driver material inwardly in any of the known metal working methods, such as beading, piercing, etc. This material is formed into the metal driver during the assembly process. An annular ridge formed in the driver in close proximity to and on the helical section side of the largest diameter section of the driver, acts as a stop for the shuttle.

The method of manufacturing the four part mechanism includes sequential steps of forming various ridges and the helical section into the metal driver during different points of the manufacturing operation. The manufacturing operation is facilitated by the few number of parts.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which an embodiment of the invention is illustrated.

BRIEF DESCRIPTION OF THE DRAWINGS

In the drawings:

FIG. 4 is a longitudinal sectional view of the driver taken through an internal helical section of the driver used to drive the pen cartridge;

FIG. 5 is a side elevational view of the driver showing the external configuration of the internal helical section and shuttle stop;

FIG. 6 is a cross-sectional view taken along line 6—6 of FIG. 5;

FIG. 7 is an enlarged sectional view of the internal helical section;

FIG. 8 is a cross-sectional view taken along line 8—8 of FIG. 5;

DESCRIPTION OF THE PREFERRED EMBODIMENTS

Figure 1:
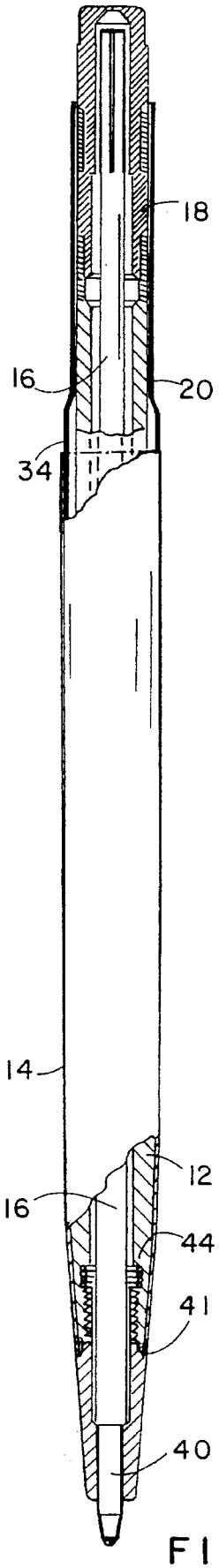
FIG. 1 is a side elevational view, with portions cut away, illustrating a ball point pen utilizing the mechanism of the present invention.
Figure 3:
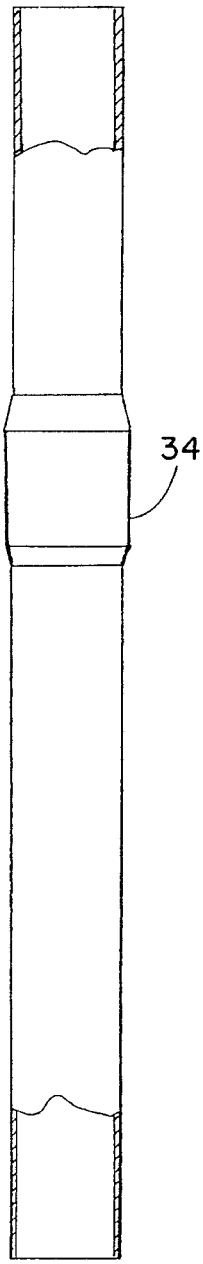
FIG. 3 is a side elevational view, partly in section of a metal driver according to the present invention, before it has been formed according to the method of the invention.
Figure 9:
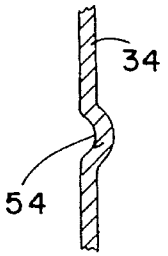
FIG. 9 is an enlarged sectional view of an annular ridge in the driver for engaging a spring of the mechanism.
Figure 10:
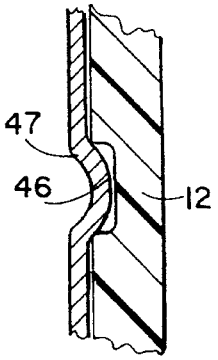
FIG. 10 is an enlarged sectional view of a portion of an anchor bushing of the present invention and an annular ridge of the driver which axially fixes the driver to the anchor bushing for rotation.

Referring to the drawings in particular, the invention embodied in FIGS. 1 through 14 comprises an anchor bushing 12 forming a fixed frame of reference for the mechanism, and which is covered by a front barrel 14 forming the outer surface of the pen as shown in FIG. 1.

Figure 2:
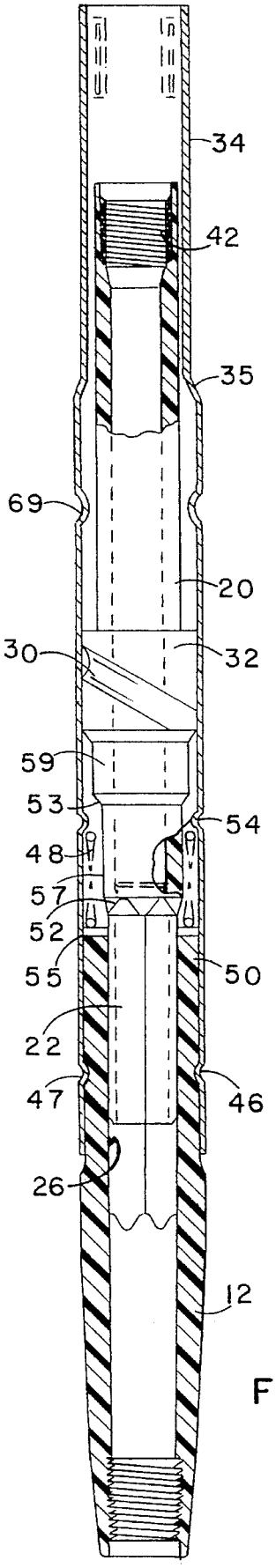
FIG. 2 is a longitudinal sectional view of the four part mechanism of the present invention.
Figure 13:
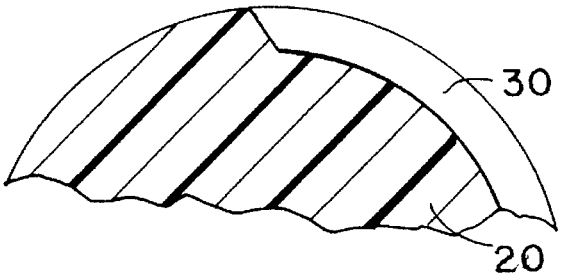
FIG. 13 is an enlarged transverse sectional view of one end of the external helical groove of the shuttle.
Figure 12:
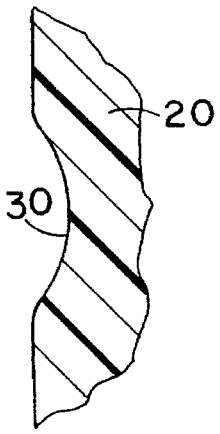
FIG. 12 is an enlarged longitudinal sectional view of an external helical groove on the shuttle.

A pen cartridge 16 is axially and non-rotationally movable within the anchor bushing 12. A cartridge top 18 of the pen cartridge 16 is fixed, for example, by threads 42 on cartridge shuttle 20 which has a front polygonal end 22 mounted for axial movement and non-rotation within a polygonal opening 26 in the anchor bushing 12 as shown in FIG. 2. An external helical groove 30 is defined around the outer surface of the cartridge shuttle 20, near the middle of the shuttle and on a large diameter portion 32 of the shuttle. Groove 30 extends around the shuttle as shown in FIG. 13.

A metal pen mechanism driver 34 is rotatably mounted to the anchor bushing 12 but axially fixed thereon, and has an internal helical section 28 that mates with the helical groove 30 on the shuttle 20. Driver 34 also has an annular ridge 69 to stop the shuttle when retracting the cartridge. See FIGS. 4, 5, 7 and 8. Rotation of the driver 34 will thus cause axial movement of the cartridge shuttle 20 in the anchor bushing 12, extending and retracting a pen tip 40 of the pen cartridge 16. The pen in FIG. 1 is shown in it extended position.

Important features of the invention over the prior art, in particular, over U.S. Pat. No. 2,753,844 to Ellery Boss, include the following:

The invention uses a one piece slippery synthetic (e.g. DELRIN 500, a trademark for an acetal resin by DuPont) cartridge shuttle 20 having slippery surfaces with a hexagonal or other nonrotational engagement element forming the polygonal end 22 at one end, a thread or other cartridge engaging element 42 at its opposite end, and central large diameter portion 32 with helical groove 30. The one piece shuttle 20 is hollow for receiving pen cartridge 16.

Tapered areas 52 and 53 are provided on the one piece cartridge shuttle 20, between 57 a forward small diameter part of cartridge shuttle 20 which allows clearance for a spring 48 when the cartridge is extended, and between the polygonal end 22 and the rearward intermediate diameter area 59, to facilitate molding of the cartridge shuttle and dropping the spring onto the shuttle.

The invention also has a one piece slippery synthetic resin (e.g. DELRIN 500) anchor bushing 12 with a forward tapered end engaged at 44 into the forward outer pen casing 14, and a rear end with hexagonal or other receiving element 26 for non-rotatable axial movement with the cartridge shuttle 20. The anchor bushing is also hollow with an outer annular groove at 46 in FIG. 10, to rotatably receive driver 34. Driver 34 is rotatable to bushing 12 but not axially movable with respect thereto since the driver is held to the bushing by a annular ridge 47 formed during the assembly process.

One piece metal pen mechanism driver 34 has a helically-shaped indentation section that forms internal helical ridge 28 and an annular indentation that forms an internal ridge 69 to stop the cartridge shuttle 20 when retracting the cartridge 16. Section 28 advantageously communicates with indentation or ridge 69. During manufacture, the cartridge shuttle 20 is dropped into and engaged with helical ridge 28 of the driver 34, at groove 30. An annular ridge or inwardly reformed area 54 is formed in driver 34. The spring 48 is dropped into the driver and slidably engages the annular ridge of the driver 34. The other end engages the end 50 of the anchor bushing 12. Mechanisms are used to insert the anchor bushing into the driver and form the annular ridge 47 in driver 34 to rotatably engage the driver to anchor bushing 12, while allowing relative rotation between the anchor bushing and the driver.

The annular ridge 54 which engages, in a non-rotatable manner, the rear end of the mechanical spring, causes the forward end to be in engagement without or with a washer 55, against the end 50 of the synthetic anchor bushing 12. This maintains a smooth operation of the pen.

The rear end of driver 34 is provided with a plurality, for example, 3, raised ribs 60 shown in FIG. 4, 5 and 6, which are forced into engagement with the inner diameter of a pen cap (not shown). The engagement between ribs 60 and the cap is sufficiently strong so that rotation of the cap causes rotation of the driver 34.

As best shown in FIG. 2, groove 30 substantially matches the inner surface of internal helical ridge 28 best shown in FIGS. 4, 5 and 7. This relationship between the inner surface of driver 34 and the outer surface of synthetic shuttle 20 makes extension and retraction of the writing mechanism smooth and effective without having to exert a large amount of force to rotate the driver. The flanks or sides of ridge 28 are each at approximately 30° to the longitudinal axis of the mechanism at angle A in FIG. 7.

Figure 11:
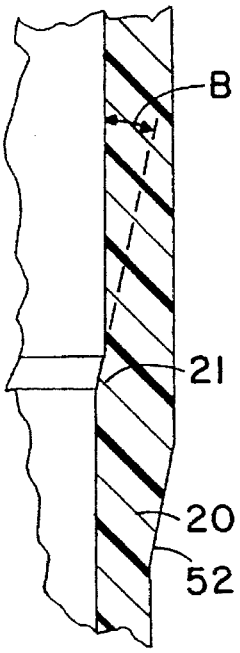
FIG. 11 is an enlarged sectional view of a portion of a cartridge shuttle forming part of the mechanism.

As shown in FIG. 11, shuttle 20 also includes an internal inclined step 21 so that the internal diameter of the shuttle is smaller near the front of the shuttle than near the back. Step 21 is inclined at an angle B of about 20°. This provides a smooth transition in the wall of the shuttle when changing outside diameter which is required for a defect free shuttle during molding. Barrel tip 41 which is fixed to the forward end of outer end barrel 14, is also fixed to anchor bushing 12, for example, by threads, adhesives, both, snap together or ultra sonics.

Figure 14:
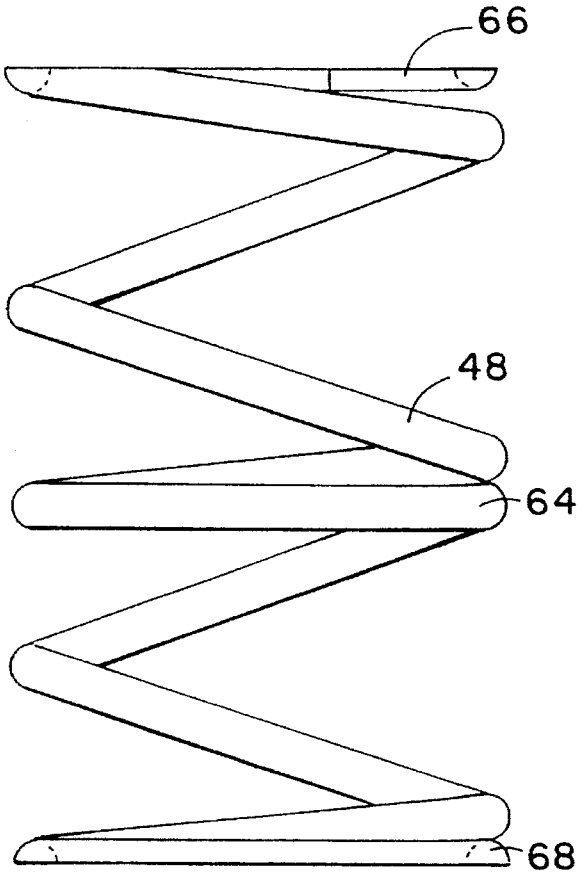
FIG. 14 is a side elevational view of a compression spring forming part of the mechanism of the present invention.

As shown in FIG. 14, the central coil 64 of spring 48 is purposely collapsed and end coils 66 and 68 are closed squared, and ground flat. The central coil being collapsed reduces tangling of the spring. Tangling is also reduced by the closed ground end coils 66 and 68 which extend parallel to their engagement surfaces, specifically the internal annular ridge 54 and the anchor bushing end 50.

As also shown in FIGS. 4 and 5, a central large diameter portion of driver 34 has an inner and outer surface which is inclined at 35 making space for smooth entry of the shuttle 20. The shuttle does not bind within the driver but instead glances off the driver when the shuttle is dropped into the driver.

Figure 15:
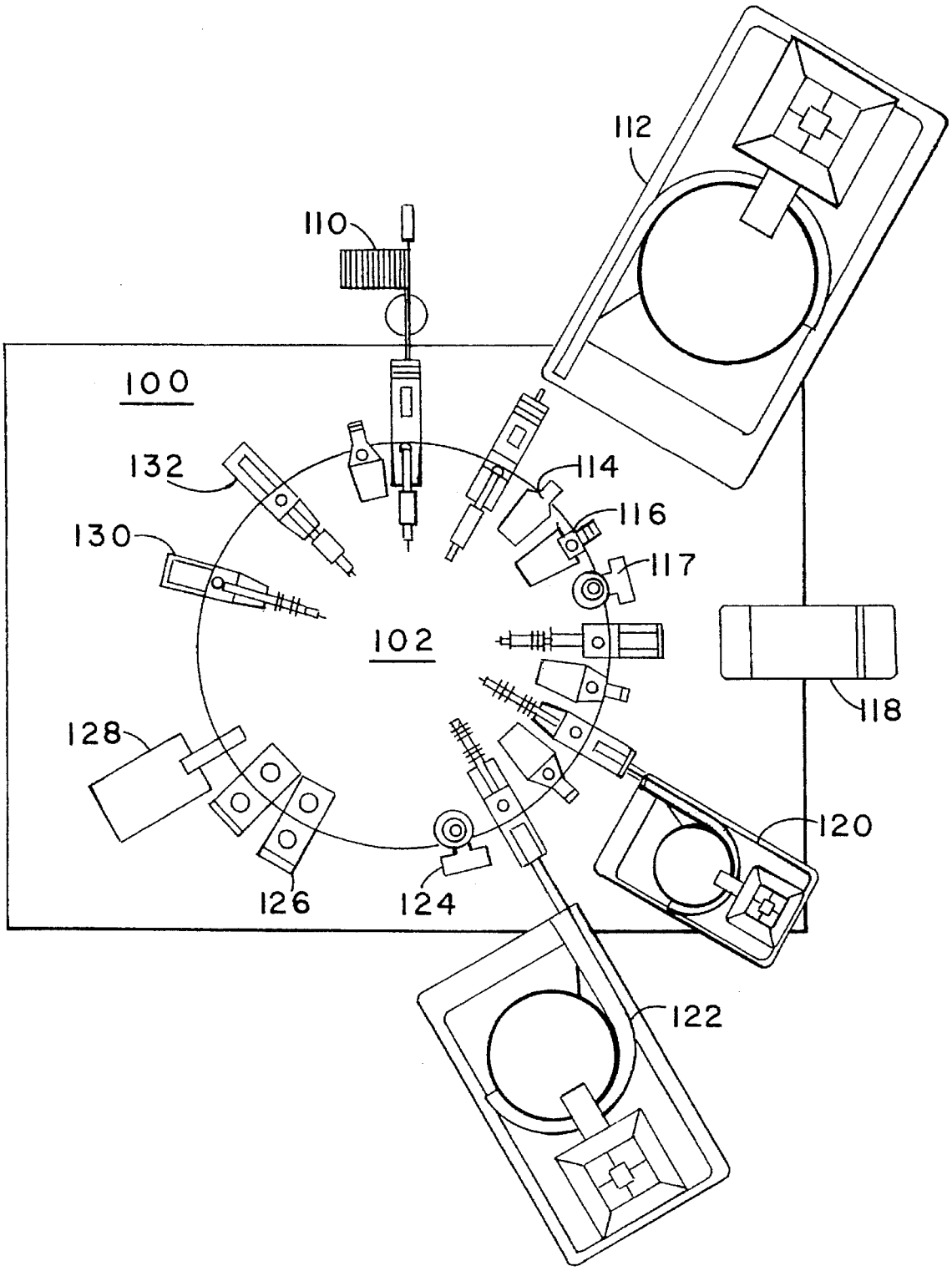
FIG. 15 is a plan view of the automatic mechanized equipment for assembling the mechanism in an automatic sequence.

Turning to FIG. 15, assembly of the mechanism is achieved using a mechanical assembly apparatus generally designated 100 comprising stations around a turntable 102. The first station at 110 comprises a magazine feed for the drivers. Station 112 is a bowl feeder for the shuttles which are inserted or dropped into the drivers 34 while they are in the condition shown in FIGS. 4 and 5, before the first and second ridges have been formed. The drivers are preformed as shown in FIGS. 4 and 5 with the ribs 60, internal helical ridge or section 28 and the internal annular ridge 69, from a blank shown in FIG. 3, by apparatus not forming part of the equipment 100.

At station 114, a grease, heavy oil or other dampening material is applied to the shuttle groove 30. At station 116, the shuttle is rotated into the driver so that section 28 engages the helical groove 30. At station 117, the driver is formed with the annular ridge 54, to form the spring seat. At station 118, spring 48 is dropped into the driver and around the shuttle. At station 122, anchor bushing 12 is inserted into the driver so that antirotation couplings 26 and 22 engage with each other. Station 124 forms the annular ridge 47 into the driver to axially fix the bushing to the driver while permitting relative rotation between these two parts (e.g., metal sliding on acetal). Station 120 is an optional operation of inserting the washer 55 before bushing 12 is inserted, if a washer is used.

A torque test is performed at station 126 and pens are provided with a date stamp at station 128. At station 130, rejects are detected and withdrawn. Accepted pen mechanisms are then supplied at station 132 from turntable 102.

All of the individual elements of apparatus 100 are known to those skilled in the art. The important aspects of the present invention are the sequence of manufacturing steps which are made possible by the simplified mechanism of the present invention.

While a specific embodiment of the invention has been shown and described in detail to illustrate the application of the principles of the invention, it will be understood that the invention may be embodied otherwise without departing from such principles.

What is claimed is:

1. A writing instrument mechanism for extending and retracting a writing tip of a writing instrument cartridge, comprising:

a one-piece slippery synthetic and hollow anchor bushing internally shaped for receiving a cartridge and having a first end through which the cartridge is movable for extending and retracting the writing tip;

a one-piece slippery synthetic and hollow cartridge shuttle internally shaped for receiving the cartridge, the shuttle including a large diameter portion with a helical groove thereon having opposite ends and extending around the large diameter portion;

cartridge fixing means on the shuttle for fixing the cartridge to the shuttle for axial movement of the cartridge in the anchor bushing;

coupling means between the bushing and the shuttle for axial non-rotating engagement between the bushing and the shuttle;

a hollow driver engaged around the anchor bushing for axially fixing the driver to the bushing while permitting relative rotation between the driver and the bushing, the driver including an internal helical section engaged with the helical groove on the large diameter portion of the shuttle for causing axial movement of the shuttle in the bushing when the driver is rotated on the bushing;

an internal annular ridge in the driver for stopping the shuttle when retracting the cartridge; and biasing means engaged between the bushing and the driver for biasing the bushing axially away from the driver.

2. A mechanism according to claim 1, wherein the shuttle includes a small diameter portion which carries part of the coupling means and an intermediate diameter portion adjacent the large diameter portion and on the same side of the shuttle as the small diameter portion, the biasing means comprising a spring with clearance around the small diameter portion.

3. A mechanism according to claim 2, wherein the coupling means comprises a non-circular forward portion of the one-piece shuttle and a tapered shoulder on the intermediate diameter portion for facilitating a drop-in operation for inserting the spring around the small diameter portion and in the driver.

4. A mechanism according to claim 3, wherein the driver is made of metal and includes a large diameter portion, and an annular ridge being in close proximity to the larger diameter of the driver.

5. A mechanism according to claim 3, wherein the driver is made of metal and includes an inwardly reformed area adjacent the small diameter portion of the shuttle and against which one end of the spring is engaged.

6. A mechanism according to claim 5, wherein the inwardly reformed area is an annular ridge, the bushing including an annular groove and the driver including a further annular ridge engaged into the annular groove for rotatably mounting the driver to the bushing while axially fixing the driver with respect to the bushing.

7. A mechanism according to claim 6, including a washer engaged between an opposite end of the spring and the bushing.

8. A mechanism according to claim 6, including a third tapered shoulder between the large diameter portion and the intermediate diameter portion.

9. A mechanism according to claim 6, wherein the cartridge fixing means comprises an internal thread in a rear relatively small diameter portion of the shuttle, for engaging a thread at a rear end of the cartridge to fix the cartridge to the shuttle.

10. A mechanism according to claim 9, wherein the bushing includes an internal thread at one end, the mechanism including a hollow writing instrument tip fixed to the thread of the one end of the bushing and through which a writing tip of the cartridge is extendable and retractable.

11. A mechanism according to claim 10, including a pen barrel engaged around the anchor bushing and retained to the anchor bushing by the tip.

12. A mechanism according to claim 1, wherein the helical section extends around the driver, the helical groove having inclined sides and extending around the large diameter portion of the shuttle.

13. A mechanism according to claim 1, wherein the biasing means comprises a spring engaged between the driver and the bushing, the spring having at least one intermediate coil which is collapsed to minimize tangling and allow for automatic feeding.

14. A mechanism according to claim 13, wherein the driver includes an annular ridge for engaging one end of the spring, the opposite end of the spring engaging the bushing.

15. A method for assembling a writing instrument for extending and retracting a writing tip of a cartridge, comprising:

providing a hollow driver with an internal helical section and with an internal annular ridge in close proximity to a large diameter portion of the driver;

dropping into and engaging with the interior of the hollow driver, a one-piece slippery synthetic and hollow cartridge shuttle with a damping fluid applied to the helical groove of the cartridge shuttle, the cartridge shuttle having a rear relatively small diameter end for entering the driver first, a large diameter portion separated from the rear portion by a shoulder for stopping the shuttle when retracting the cartridge and the helical groove being around the large diameter portion for engagement with the internal helical section;

forming an annular ridge around the driver for retaining a spring;

dropping a spring into the driver and around the shuttle;

dropping a one-piece slippery synthetic and hollow anchor bushing into the driver and into engagement with the shuttle, the bushing having an annular groove; and forming a further ridge in the driver and into the annular groove of the bushing for rotatably mounting and axially fixing the bushing to the driver.

16. A method according to claim 15, including providing a small diameter portion on the shuttle with clearance for an inside diameter of the spring, the shuttle being provided with a forward polygonal portion for engaging a rearward internal polygonal portion of the anchor bushing for allowing axial but nonrotational engagement between the bushing and the shuttle, and providing the shuttle with a tapered shoulder between the intermediate diameter portion and the forward polygonal portion for facilitating dropping in of the spring.

17. A method according to claim 16, including dropping a washer into the driver before dropping the anchor bushing into the driver for placing the washer between the spring and the bushing.

18. A method according to claim 15, including turning the shuttle after it is dropped into the driver for engaging the helical groove onto the helical section.

* * * * *